US005201669A

United States Patent [19]

Lin

[11] Patent Number: 5,201,669

[45] Date of Patent: Apr. 13, 1993

[54] CONNECTION DEVICE OF A COMPUTER CONNECTION

[75] Inventor: Chao-Tsung Lin, Hsin-Tien, Taiwan

[73] Assignee: Advanced-Connectek Inc., Taipai, Taiwan

[21] Appl. No.: 760,499

[22] Filed: Sep. 16, 1991

[51] Int. Cl.[5] ..... H01R 13/73

[52] U.S. Cl. ..... 439/357; 439/350

[58] Field of Search ..... 439/350–358

[56] References Cited

U.S. PATENT DOCUMENTS 4,961,711 10/1990 Fujiura et al. ..... 439/357

5,011,424 4/1991 Simmons ..... 439/352

*Primary Examiner*—Larry I. Schwartz

*Assistant Examiner*—Hien D. Vu

*Attorney, Agent, or Firm*—Lowe, Price, LeBlanc & Becker

[57] ABSTRACT

A connection device of a computer connector comprising a clip piece composed of a metal spring leaf and a press-button fixed onto said metal spring leaf, and an insertion socket in the shape of long sheet provided in the clip hole on the side of the shell of the connector stand wherein, in the central portion of the metal spring leaf of the clip piece, two corresponding protrusions in the form of "["-shape sheet is stamped in order that the clip piece will be inserted into the insertion socket in the form of long sheet through the clip hole; one end of the metal spring leaf of the clip piece is in the form of a hook to hook-coupling with the head piece of the computer connector; and the other end of the metal spring leaf of the clip piece is clutched with the press-button. Thus, the computer connector is quick in production and assembly, easy in application, simple in maintenance and replacement, firm in location and wide in the applied field.

5 Claims, 6 Drawing Sheets

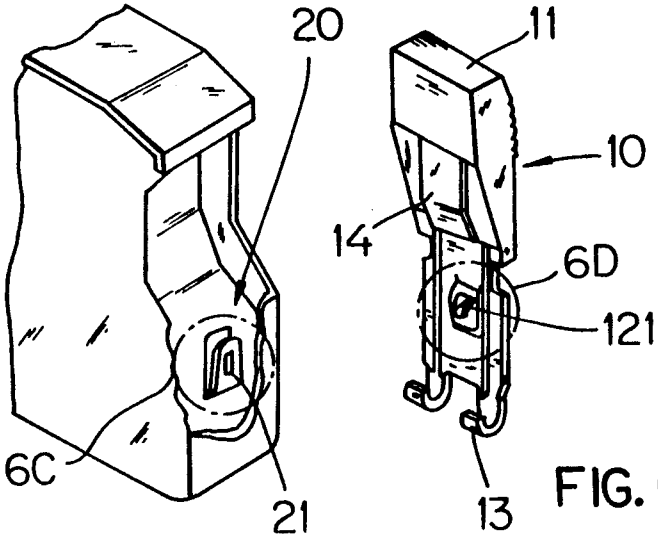
FIG. 6A
FIG. 6B
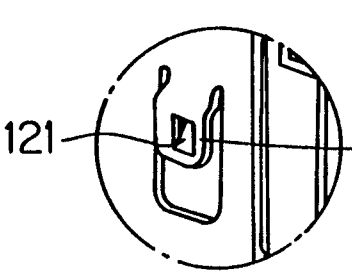
FIG. 6D
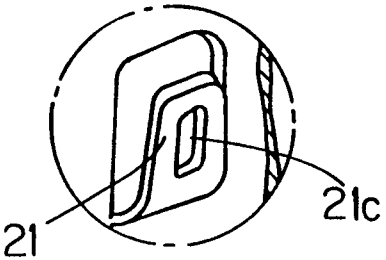
FIG. 6C
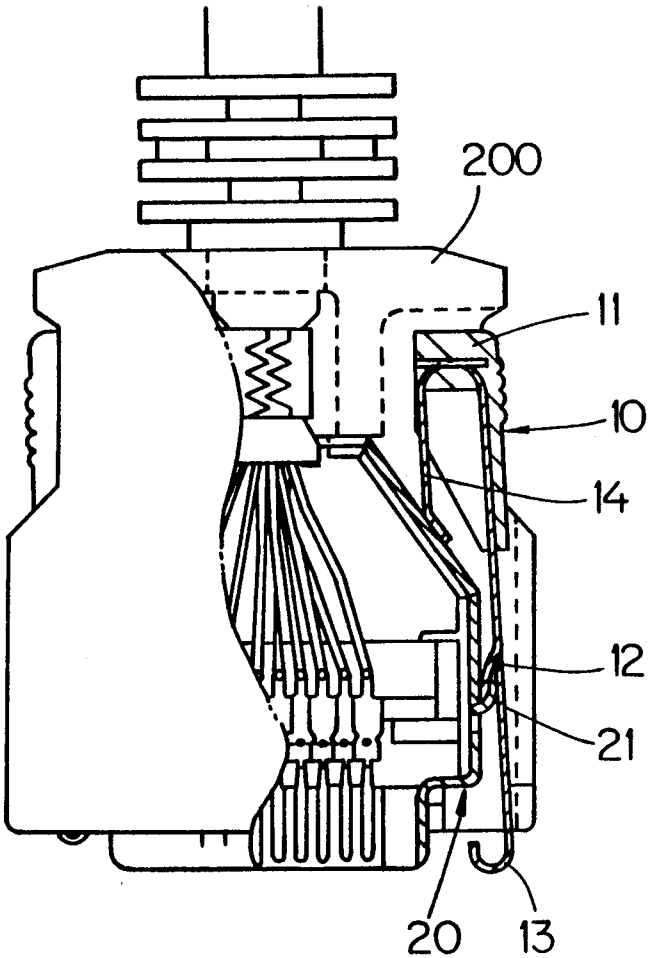
FIG. 6

CONNECTION DEVICE OF A COMPUTER CONNECTION

BACKGROUND OF THE INVENTION

1. Field of the Invention

The present invention relates to a connection device of a computer connector, especially to one which has the clip piece located in the shell of the connector.

2. Description of the Prior Art

The present invention relates to a connection device of a computer connector.

Conventional connection mechanism of a computer connector, such as that shown in FIG. 1, is still unsatisfactory in the respect of assembly, production, maintenance and replacement.

Referring to FIG. 1, in the conventional connection structure of computer connector a hole is punched in the middle section of the fixing plate 203. An upward protruding hooked stud 201*c* on the side wall of the inner shell 201 of the connector 200 is inserted into this hole. The fixing plate 203 corresponds to the clip socket 301 of the computer. At the bottom of the fixing plate, the hook 203*b* can grasp the hook piece 302, 303 of the clip socket 301 to get a locking effect. Accordingly, the computer connector 200 will not detach from the clip socket 301 connected. But while the operator presses the press-board 203*a* of the connector 200 lightly, the above locking effect will disappear at once.

However, said connection construction of a computer connector has the following inconvenience in use: said fixing plate 203 is hook fixed to the upward protruding hooked stud 201*c* on the inner shell 201 of the connector by only one fulcrum. During the course of long term use, it is easy to detach in use or assembly due to metal fatigue.

In view of the above mentioned disadvantages of the conventional connection construction of a computer connector, the Inventor made an extensive research in improving them and finally created the construction of the invention.

SUMMARY OF THE INVENTION

Thus, the present invention is directed to provide a connection device of a computer connector. A principal object of the invention is to provide a connection device of a computer connector which has a clip piece having double protrusion-hooked stud provided on each side of the inner shell of the connection device. When an operator inserts said clip piece into the insertion socket provided on both sides of the connector, the protrusion-hooked stud (in a corresponding form of "[") at the central clip piece can quickly and firmly lock the clip piece to the side of the connector without detachment.

Another object of the invention is to provide a connection device of a computer connector which has the clip piece thereof having a hook at an end to hook the socket and the other end in a form of "∩" or "∫" depending on the type of the connector and coupled with a press button so that it can avoid wetting out and leakage.

With respect to the detailed construction, applied principles, actions and effects, it will be fully understood by the description with reference to the accompanying drawings.

BRIEF DESCRIPTION OF THE DRAWINGS

FIGS. 6 and 6A–6D are diagrams showing different views of another embodiment of the invention.

DESCRIPTION OF THE PREFERRED EMBODIMENTS

Figure 1A:
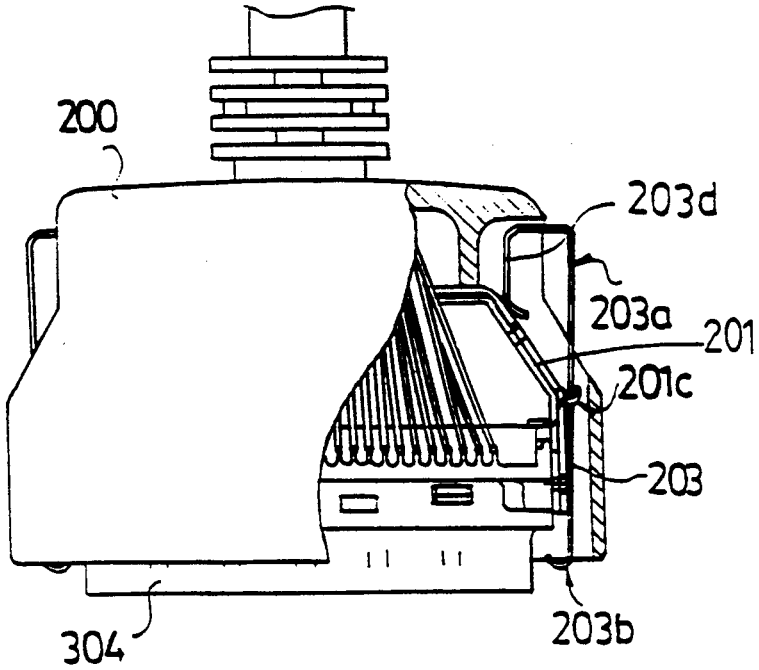
FIGS. 1 and 1A show different views of a conventional connector.
Figure 1:
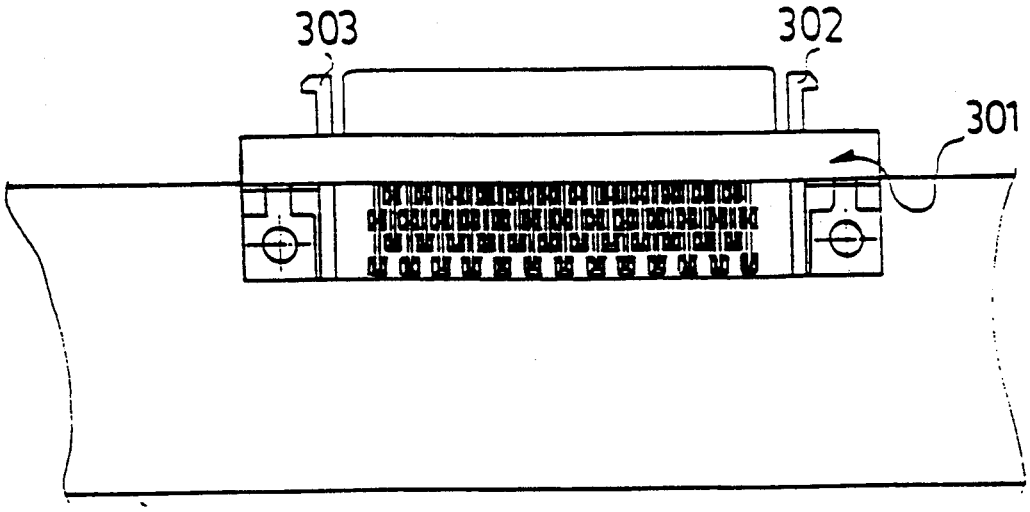
FIG.1 (PRIOR ART)

FIGS. 1 and 1A show a conventional construction of the computer connector. The structure mechanism and drawbacks are as described above and will not be repeated here.

Figure 2A:
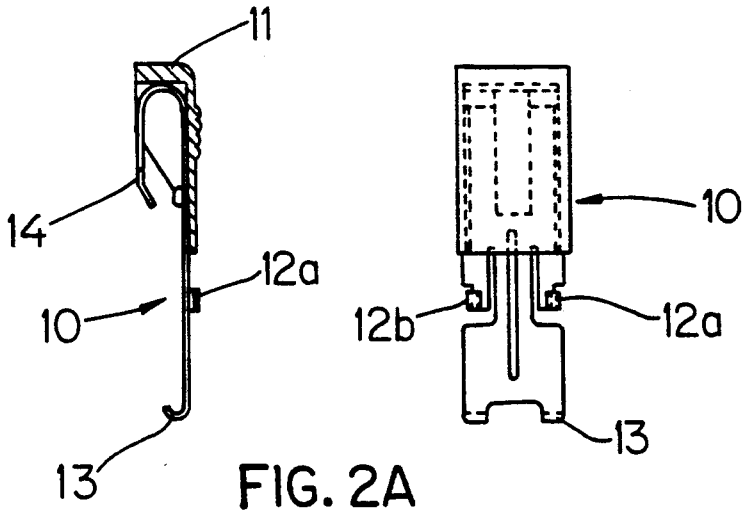
FIG. 2A is a diagram showing the clip piece of the present invention.
Figure 2B:
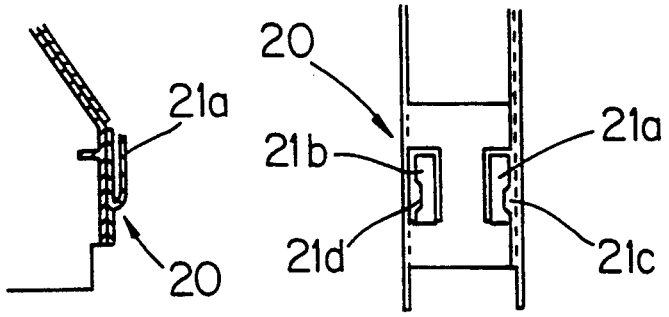
FIG. 2B is a diagram showing the insertion socket of the present invention.
Figure 2C:
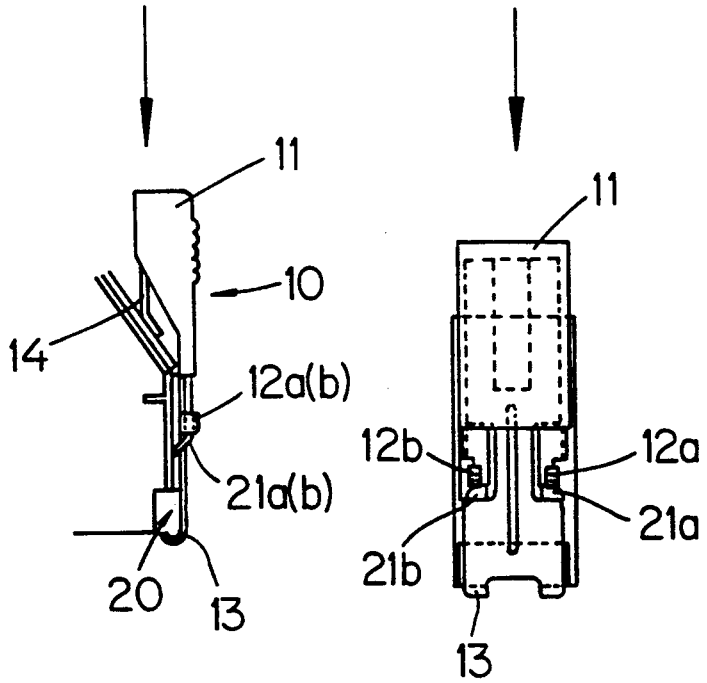
FIG. 2C is a diagram showing the details of the connection device of the invention.
Figure 3:
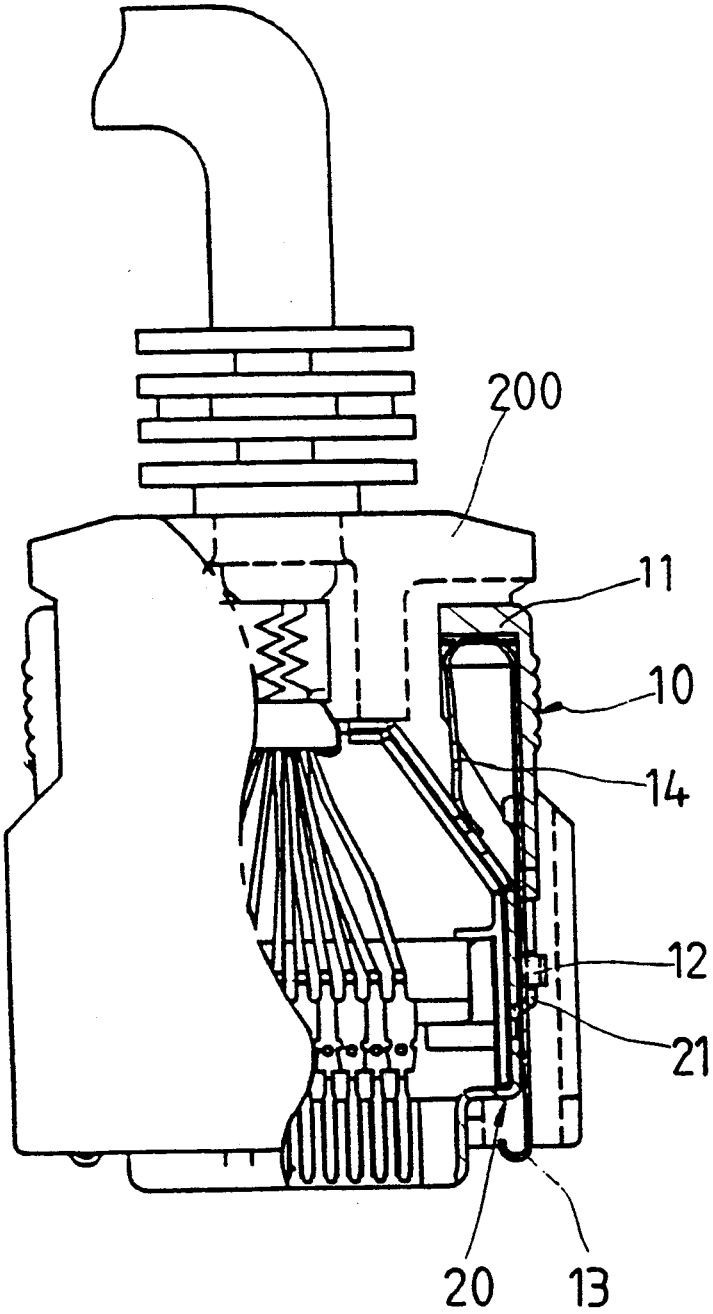
FIG. 3 is a longitudinal sectional view of the device of the invention.
Figure 5:
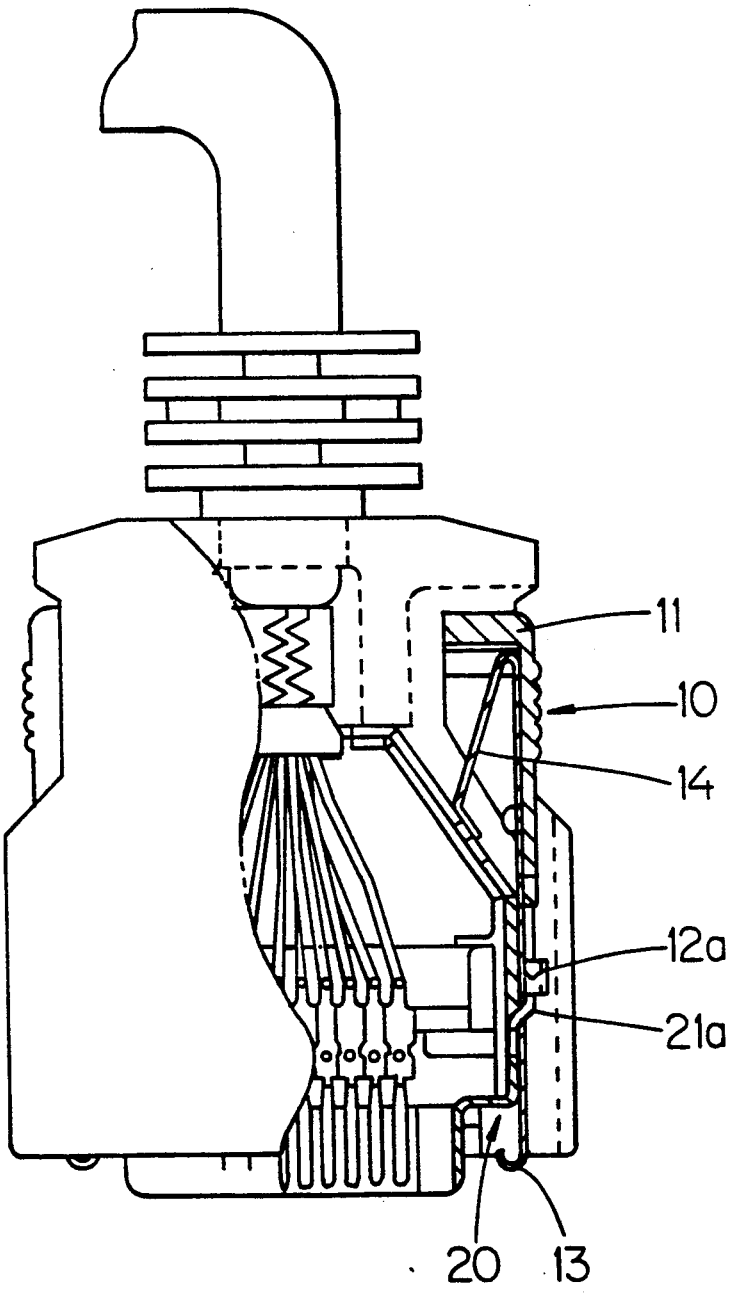
FIG. 5 is a longitudinal section view of an embodiment of the invention.

FIGS. 2A–2C show the connection device of the invention. It can be clearly seen that the connection device of the invention mainly comprises a clip piece 10 and an insertion socket 20; two hooked studs 12*a*, 12*b* are stamped at the central part of a metal spring leaf 14 of the clip piece 10; ends of the spring leaf are provided with a claw hook; the head thereof is in the shape of "∩" or "∫" to be adapted to various connectors 200 or press-buttons 11; the insertion socket 20 is formed at the side of the inner shell of the connecting device which is composed of two outwardly turned long sheets of insertion plates 21*a*, 21*b* projected from the central side of the inner shell of the connector. When assembling the connector 200, the inner shell having the insertion socket 20 is jointed with the terminal stand, meanwhile, the insertion plates 21*a*, 21*b* on the insertion socket 20 will be open and upward projecting, and then the clip piece 10 is accurately inserted downward to insert correspondingly the hooked studs 12*a*, 12*b* of the clip piece 10 into the plate recess 21*c*, 21*d* of the insertion plates 21*a*, 21*b*. While not in use, the press-button 11 of the clip piece 10 is pressed lightly by a finger to move toward the clip hole of the connector 200. At the time, the hooked studs 12*a*, 12*b* of the clip piece 10 and the insertion plates 21*a*, 21*b* of the insertion socket 20 are used together (see FIGS. 3 and 5), the claw hook 13 at the bottom end of the clip piece 10 rebounds outwardly reversely, and the distance between the claw hooks 13 of the spring leaf inside of the clip holes on both sides of the connector socket increases, then the space between the claw hooks original in retaining state is big enough to detach from the computer main stand.

Figure 4:
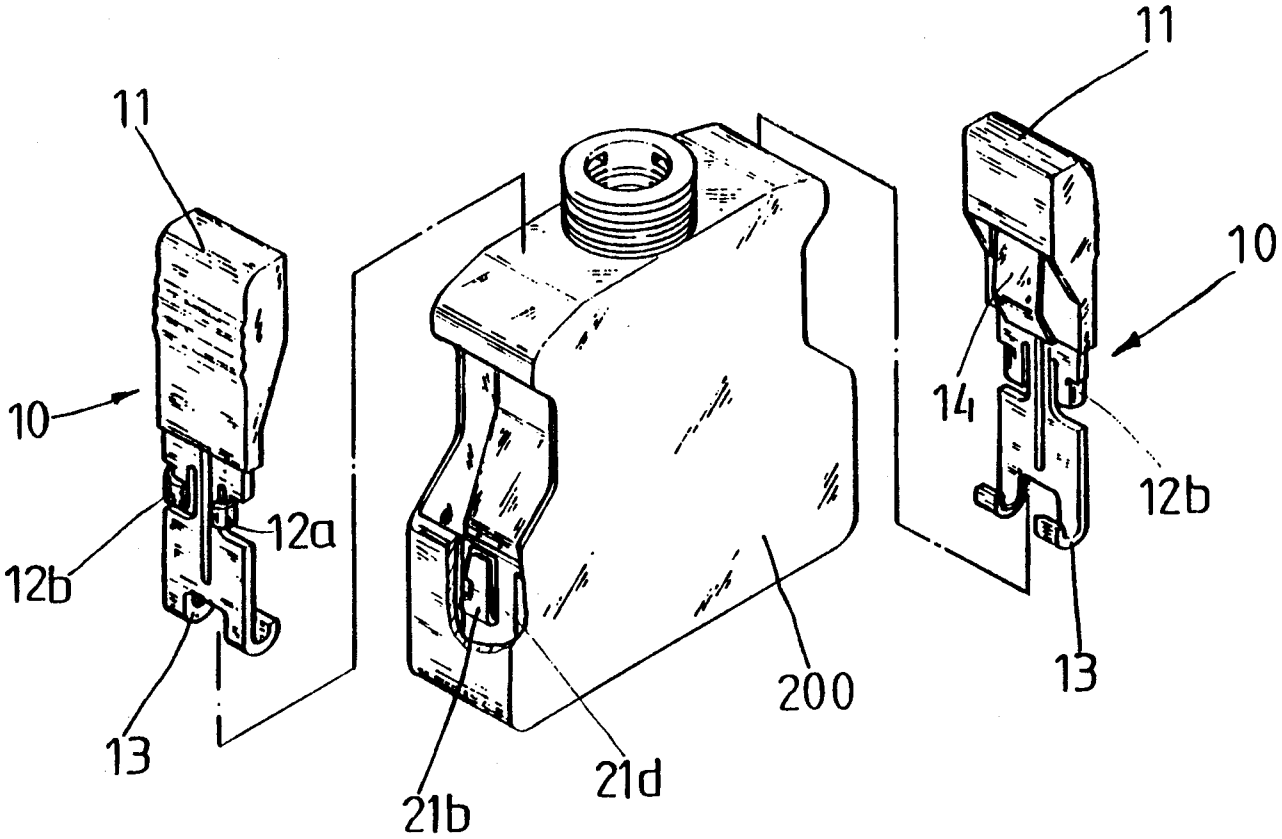
FIG. 4 is an exploded perspective schematic view showing elements of the device of the invention.

FIG. 4 is a perspective schematic view showing elements of the device of the invention. The position interrelationship between the clip piece 10, the connector 200 and the insertion socket 20 are more clearly shown in FIG. 4.

FIGS. 6 and 6A–6D show another embodiment of the invention. It can be seen from the figures, in the clip piece 10 of this type, the socket 20 is formed with a plate 21 establishing a gap with the side wall of the socket, and the hook leaf 12 thereof is stamped to be a downward slant hook having upside down hook studs 12*a*, 12*b* to be inserted correspondingly into the plate recess 21*c*, 21*a* of plate 21. Thus, to join hook studs 121 of hook leafs 12 to the insertion plates 21 on the side walls of the insertion socket 20, simply insert the clip piece 10 into the connector socket 200, as shown in FIG. 6, and the hook leafs 12 will slide behind insertion plates 21, with hook studs 121 of the hook leafs 12 becoming seated in recesses 21*a* of the hook leafs 12. The remaining functions and actions are as described hereinbefore.

In view of the above, the connection device of a computer connector according to the invention actually possesses the characteristics such as, better effectiveness, excellent safety, no detachment, easy assembly and production and quick maintenance and replacement, which is really superior to the convention connection device of a computer connector.

It will be appreciated that various changes and modifications can be made in the details of the device and construction as herein described without departing from the scope of the invention as set forth in the appended claims.

I claim:

1. A connection device of a computer connector comprising a clip piece including a metal spring leaf and a press-button fixed onto said metal spring leaf, and an insertion socket having a long sheet provided on the side surface of a shell of the connection device, which is characterized in that the central portion of the metal spring leaf of the clip piece has two corresponding hooks extending outwardly beyond the shell in order to engage the insertion socket; one end of the metal spring leaf of the clip piece is in the form of a hook for hook-coupling with the head portion of the computer connector; and the other end of the metal spring leaf of the clip piece is clutched with the press-button.

2. A connection device of a computer connector as claimed in claim 1, wherein, two outward turned long sheets are stamped on each side of the inner shell of the connection device.

3. An electrical connector according to claim 1, wherein the insertion socket comprises a tab member bent to engage the hook member.

4. An electrical connector according to claim 1, wherein the pressure-actuated means comprises a press-button.

5. An electrical connector having an outer housing and an inner body for electrical connection with an electrical complementary connector, comprising:

an insertion socket formed with a plate establishing a gap between a side surface of said inner body and the plate;

a clip member including a spring member having a central portion, a first end bent to engage the inner body and a second end bent to lock the connector to the complementary connector;

said outer housing having an opening on a side wall for receiving said clip member;

pressure-actuated means mounted on the spring member and operable to unlock the connector from the complementary connector; and a hook member mounted on the central portion of the spring member, said hook member having a leg extending outside of the side surface of the inner body to engage the insertion socket.

* * * * *